US006201507B1

(12) United States Patent
Park et al.

(10) Patent No.: US 6,201,507 B1
(45) **Date of Patent: *Mar. 13, 2001**

(54) CENTERED LONGITUDINAL SHUNT SLOT FED BY A RESONANT OFFSET RIDGE IRIS

(75) Inventors: Pyong K. Park; Sang H. Kim, both of Tucson, AZ (US)

(73) Assignee: Raytheon Company, Lexington, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/058,112

(22) Filed: Apr. 9, 1998

(51) Int. Cl.[7] ..... H01Q 13/10

(52) U.S. Cl. ..... 343/771; 343/767; 343/770; 333/137

(58) Field of Search ..... 343/770, 771, 343/767, 700 MS, 772, 909; 333/114, 137, 251; H01Q 13/10

(56) References Cited

U.S. PATENT DOCUMENTS

| | | | | |
|---|---|---|---|---|
| 4,491,810 | * | 1/1985 | Saad | 333/126 |
| 4,839,663 | * | 6/1989 | Kurtz | 343/771 |
| 5,010,351 | * | 4/1991 | Kelly | 343/771 |
| 5,543,810 | * | 8/1996 | Park | 343/771 |
| 5,619,216 | * | 4/1997 | Park | 343/771 |

* cited by examiner

*Primary Examiner*—Tho Phan
(74) *Attorney, Agent, or Firm*—David W. Collins; Glenn H. Lenzen, Jr.

(57) ABSTRACT

A radiator (10) comprising one or more centered longitudinal shunt slots (12) disposed in a rectangular waveguide (11) that are fed by corresponding offset ridge resonant irises (14). The offset ridge resonant irises that are centered on each respective slot. When multiple slots and offset ridge resonant irises are employed, adjacent irises are oriented opposite to one another.

5 Claims, 3 Drawing Sheets

CENTERED LONGITUDINAL BROADWALL SLOT IN A RECTANDULAR WAVEGUIDE DOES NOT RADIATE

L-SHAPED OFFSET RESONANT IRIS EXCITING A CENTERED LONGITUDINAL SLOT

OFFSET RESONANT IRISEXCITING A CENTERED LONGITUDINAL SLOT

CENTERED LONGITUDINAL SHUNT SLOT FED BY A RESONANT OFFSET RIDGE IRIS

BACKGROUND

The present invention relates generally to radiators, and more particularly, to the use of a centered longitudinal shunt slot disposed in a broadwall of a rectangular waveguide that is fed by an offset ridge resonant iris.

An advanced seeker under development by the assignee of the present invention requires a common aperture dual polarized antenna. There are several ways to provide a dual polarized antenna having a common aperture. To provide a large aperture, a dipole array and slot array combination is very attractive. For this combination, centered longitudinal shunt slots must be used because an offset longitudinal shunt slot excites not only a desired lowest parallel plate mode but also undesirable higher order modes in the parallel plate region created by the dipole array. The centered longitudinal shunt slot excites only the desired lowest mode (TEM).

However, a centered longitudinal broadwall slot in a rectangular waveguide does not radiate because the centered longitudinal slot does not disturb the current flow of the TE10 mode. The prior art used an L-shaped offset resonant iris to excite the centered longitudinal slot.

Centered longitudinal broadwall slots fed by L-shaped resonant irises have heretofore been used to produce a linear antenna array. This antenna array is disclosed in a paper by R. Tang, entitled "A slot with variable coupling and its application to a linear array:, IRE Trans. AP-8, p. 97, 1960. This linear antenna array has a relatively inefficient layout, exhibits an undesirable phase change in terms of offset variation, has a somewhat unstable conductance range, and is relatively difficult to machine and dip braze.

Accordingly, it is an objective of the present invention to provide for the use of a centered longitudinal shunt slot disposed in a broadwall of a rectangular waveguide that is fed by an offset ridge resonant iris, and which is particularly well adapted for use in a common aperture dual polarized antenna.

SUMMARY OF THE INVENTION

To meet the above and other objectives, the present invention provides for a radiator comprising a centered longitudinal shunt slot disposed in rectangular waveguide that is fed by an offset ridge resonant iris having a finite thickness. Depending upon the application, the rectangular waveguide has one or more centered longitudinal shunt slots that are fed by corresponding offset ridge resonant irises that are centered on each respective slot. Typically the offset ridge resonant irises are oriented opposite to each other within a particular waveguide to change the radiating phase by 180 degrees.

The present radiator provides for an improved common aperture antenna layout, for example, compared to a conventional antenna array using offset shunt slots fed by a rectangular waveguide. The antenna array constructed using centered longitudinal shunt slots disposed in a rectangular waveguide that is fed by offset ridge resonant irises in accordance with the present invention reduces undesirable phase changes in terms of the offset variation compared to conventional antenna arrays having centered longitudinal shunt slots fed by L-shape offset resonant irises of the same finite thickness at a higher frequency. An antenna array constructed in accordance with the present invention has a more stable conductance range than one that uses L-shaped irises. Furthermore, an antenna array employing the offset ridge resonant irises and centered longitudinal shunt slot is easy to machine and dip braze.

The present invention improves upon the prior art in the following three ways. The use of centered longitudinal shunt slots fed by an offset ridge resonant irises makes it possible to design a low sidelobe antenna by having a large range of radiating conductance with constant radiating phase. The present invention reduces the undesirable phase advances due to the use of offset L-shaped irises. The offset ridge resonant irises are easy to fabricate because ridge irises are easy to machine and the ridge irises provide a salt drain path for dip brazing processes. The use of centered longitudinal shunt slots fed by rectangular waveguides is desirable because it produces a low sidelobe antenna pattern when used in a dual polarized common aperature antenna.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
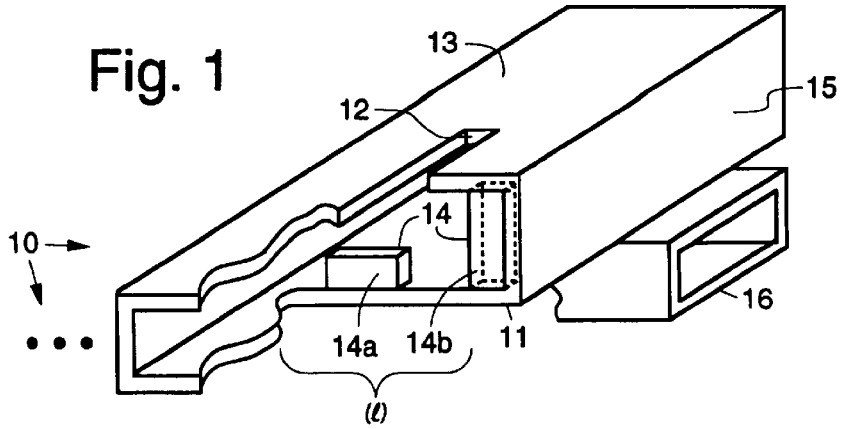
FIG. 1 illustrates a partially cutaway view of a radiator comprising a centered longitudinal shunt slot fed by an offset ridge resonant iris in accordance with the principles of the present invention.

Referring to the drawing figures, FIG. 1 illustrates a partially cutaway view of a radiator 10 in accordance with the principles of the present invention. The radiator 10 comprises a centered longitudinal shunt slot 12 disposed in a broadwall 13 of a waveguide 11 that is fed by an offset ridge resonant iris 14. The waveguide 11 may be fed by a feed waveguide 16, for example, or other convenient feed arrangement 16.

The rectangular waveguide 11 has one or more centered longitudinal shunt slots 12 disposed in its broadwall 13. The one or more centered longitudinal shunt slots 12 are fed by corresponding offset ridge resonant irises 14 that are disposed within the waveguide 11 and which are centered on each respective slot 12. Each offset ridge resonant iris 14 is comprised of a first portion 14*a* that is disposed within the waveguide 11 on an opposite internal broadwall of the waveguide 11 relative to the slot 12 . The first portion 14*a* of each offset ridge resonant iris 14 has a length that is a predetermined portion of the width of the waveguide 11. Each offset ridge resonant iris 14 also has a second portion 14*b* that is disposed on a selected internal lateral sidewall 15 of the waveguide 11 relative to the slot 12. Each offset ridge resonant iris 14 has a finite thickness, typically on the order of 16–25 mils when used to radiate energy in the Ka frequency band.

Figure 2:
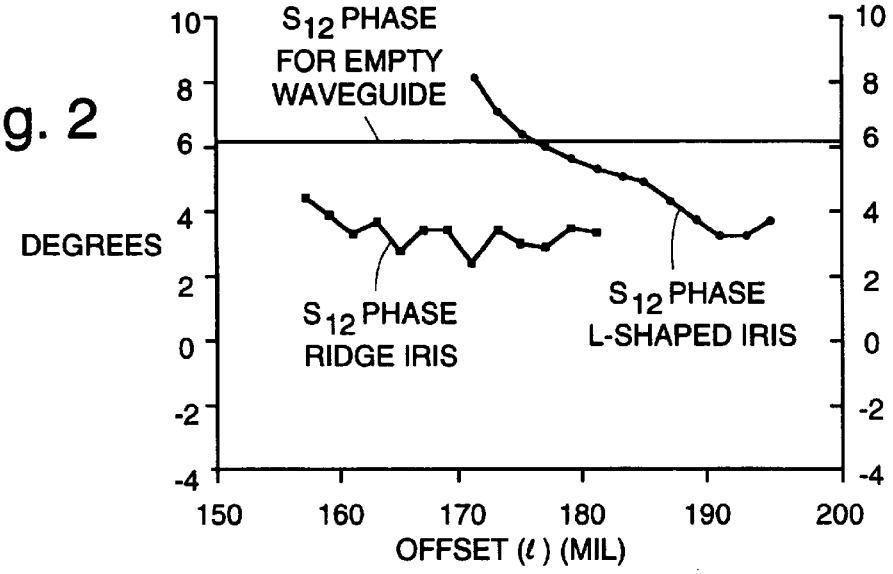
FIG. 2 is a graph of phase comparisons between an empty waveguide, a ridge iris used in the present invention, and a conventional L-shaped iris and illustrates the reduction in phase advance provided by the antenna array of FIG. 1.

The improvements provided by the present radiator 10 will now be discussed with reference to conventional antenna arrays. FIG. 2 is a graph of phase comparisons between an empty waveguide 11, a ridge iris 14 disposed in a waveguide 11 as used in the present invention, and a conventional L-shaped iris disposed in a waveguide 11, and illustrates the reduction in phase advance provided by the radiator 10 of FIG. 1.

FIG. 2 shows that the $S_{12}$ phase for the ridge iris 14 disposed in the waveguide 11 is more parallel to the $S_{12}$ phase of the empty waveguide 11 than the $S_{12}$ phase of an L-shape iris disposed in the waveguide 21. FIG. 2 shows a typical phase dispersion due to an iris of a finite thickness. The phase dispersion of the ridge iris 14 is less than that of the L-shaped resonant iris. The offset (1) is shown in FIG. 1.

A rectangular waveguide 11 that uses a finite thickness L-shaped resonant iris introduces undesirable phase advancement compared to the same length of an empty rectangular waveguide 11 because the propagation constant in the L-shaped iris is smaller than that in the rectangular waveguide 11. The propagation constant in the L-shaped iris is smaller than that in the rectangular waveguide 11 because the opening width of the resonant iris is smaller than the rectangular waveguide 11. The undesirable phase advancement due to a finite thickness L-shaped iris increases as the frequency increases because a typical minimum thickness of the iris (e.g., 16 mils) for manufacturing is much thicker in the electrical sense for a higher frequency.

Consequently, the offset resonant ridge iris 14 of the present invention is used to alleviate the phase advancement due to a finite thickness iris. The propagation constant of the offset resonant ridge iris 14 is much closer to that of the rectangular waveguide 11, as is shown in FIG. 2.

Figure 3:
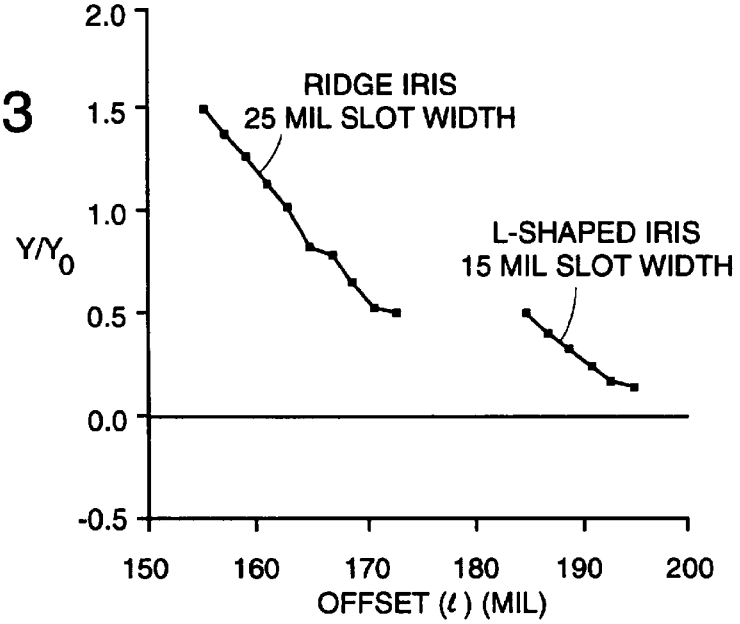
FIG. 3 is a graph illustrating normalized conductance of a longitudinal shunt slot as a function of the offset of an iris.

FIG. 3 is a graph illustrating normalized conductance of a longitudinal shunt slot 12 as a function of the offset of an iris, for the ridge iris 14 disposed in the waveguide 11 of the present invention compared to a conventional L-shaped iris disposed in the waveguide 11. The offset (1) is shown in FIG. 1.

Figure 4:
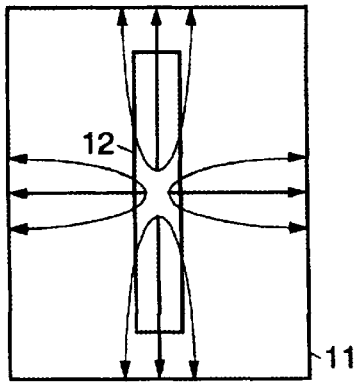
Fig. 4 (prior art)
FIG. 4 illustrates that a centered longitudinal slot in a rectangular waveguide does not radiate.
Figure 5:
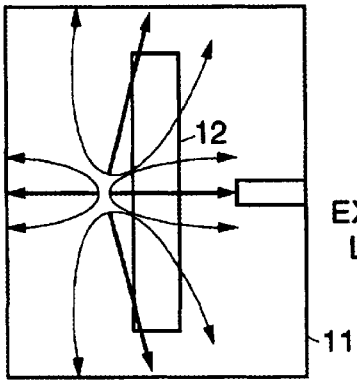
Fig. 5 (prior art)
FIG. 5 illustrates a radiating pattern of an L-shaped offset resonant exciting a centered longitudinal slot in a rectangular waveguide.
Figure 6:
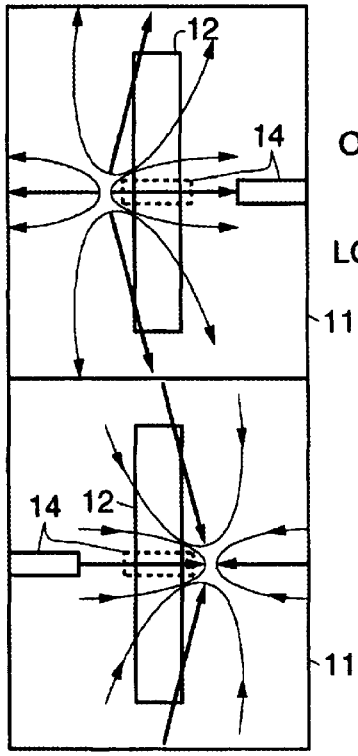
FIG. 6 illustrates a radiating pattern of an offset resonant iris exciting a centered longitudinal slot in a rectangular waveguide in accordance with the principles of the present invention.

A better understanding of the present invention may be had with reference to FIGS. 4–6. FIG. 4 illustrates that a centered longitudinal slot in a rectangular waveguide does not radiate. FIG. 5 illustrates a radiating pattern of an conventionally-used L-shaped offset resonant exciting a centered longitudinal slot in a rectangular waveguide. A rectangular waveguide having a finite thickness L-shaped resonant iris introduces undesirable phase advancement (FIG. 5) compared to the same length of an empty rectangular waveguide (FIG. 4) because the propagation constant in the L-shaped iris is smaller than that in a rectangular waveguide. The propagation constant in the L-shaped iris is smaller than that in the rectangular waveguide because the opening width of the resonant iris is smaller than the rectangular waveguide. The undesirable phase advancement due to a finite thickness iris increases as the frequency increases because the minimum thickness of iris (e.g., 16 mils) for manufacturing is much thicker in the electrical sense for a higher frequency.

FIG. 6 illustrates a radiating pattern of the offset resonant iris 14 exciting a centered longitudinal slot 12 in a rectangular waveguide 11 in accordance with the principles of the present invention, such as is shown in FIG. 1. The centered longitudinal shunt slot 12 having the offset resonant iris 14 radiates because the surface current on the broadside of the rectangular waveguide 11 is distorted in such a way that the centered longitudinal slot 12 interacts with that distorted current as shown in FIG. 2. The amount of radiation radiated by the centered longitudinal shunt slot 12 may be controlled by selecting the amount of offset between the first and second portions 14*a*, 14*b* of the ridge iris 14, and the radiating phase may be changed by changed 180 degrees by reversing the direction of the iris 14 within the waveguide 11 as shown in the bottom portion of FIG. 6.

Figure 7:
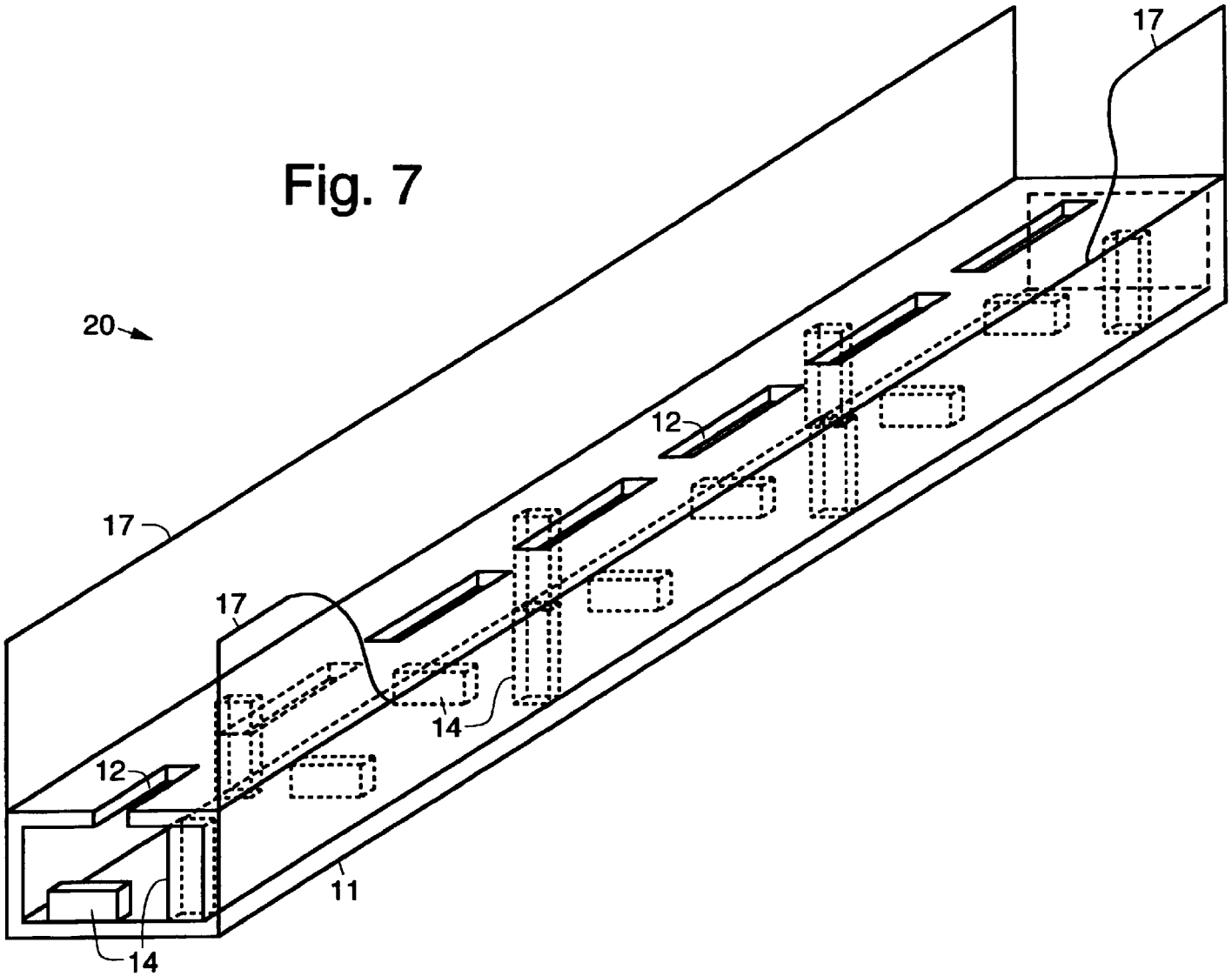
FIG. 7 illustrates a portion of a typical antenna implemented in accordance with the principles of the present invention.

FIG. 7 illustrates a portion of a typical antenna 20 implemented in accordance with the principles of the present invention. The antenna 20 comprises a rectangular waveguide 11 having a plurality of centered longitudinal slots 12 disposed in its broadwall 13. Baffles 17 extend vertically along edges of the lateral sidewalls 15 and away from the broadwall 13 of the waveguide 11. A plurality of offset resonant irises 14 are disposed within the waveguide 11 that are centered in respective slots 12. The directions of adjacent irises 14 are oriented opposite to one another.

Thus, the present antenna 20 combines the use a rectangular waveguide 11 having centered longitudinal slots 12 and adjacent baffles 17, along with a plurality of offset resonant irises 14 disposed in the waveguide 11 that are respectively centered on the slots 12. This arrangement produces a low sidelobe antenna pattern when used in a dual polarized common aperature antenna.

Thus, an improved radiator has been disclosed that has a centered longitudinal shunt slot disposed in a rectangular waveguide that is fed by offset ridge resonant iris. It is to be understood that the described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A radiator comprising:

a rectangular waveguide;

a centered longitudinal shunt slot disposed in a broadwall of the rectangular waveguide;

an offset ridge resonant iris disposed in the waveguide that is centered on the shunt slot for coupling energy to the shunt slot, to offset ridge resonant iris comprising two separated portions, a first portion within the waveguide on an opposite internal broadwall of the waveguide relative to the shunt slot and a second portion on a selected internal lateral sidewall of the waveguide relative to the shunt slot; and a feed arrangement coupled to the rectangular waveguide for coupling energy thereto.

2. A radiator comprising:

a rectangular waveguide;

a plurality of centered longitudinal shunt slots disposed in a broadwall of the rectangular waveguide, and a corresponding plurality of offset ridge resonant irises disposed in the waveguide that are centered on the respective shunt slots for coupling energy to the shunt slots, each offset ridge resonant iris comprising two separated portions, a first portion within the waveguide on an opposite internal broadwall of waveguide relative to the shunt slots and a second portion on a selected internal lateral sidewall of the waveguide relative to the shunt slots; and a feed arrangement coupled to the rectangular waveguide for coupling energy thereto.

3. The radiator of claim 2 wherein adjacent irises are oriented opposite to one another.

4. A radiator comprising:

a plurality of rectangular waveguides;

a centered longitudinal shunt slot disposed in a broadwall of each rectangular waveguide;

an offset ridge resonant iris disposed in each waveguide that is centered on the shunt slot for coupling energy to the shunt slot, the offset ridge resonant iris comprising two separated portions, a first portion within each waveguide on an opposite internal broadwall of the waveguide relative to the shunt slot and a second portion on a selected internal lateral sidewall of each waveguide relative to the shunt slot; and a feed arrangement coupled to the plurality of rectangular waveguides for coupling energy thereto.

5. The radiator of claim 4 wherein adjacent irises are oriented opposite to one another.

* * * * *